US011264161B2

(12) United States Patent
Yoon et al.

(10) Patent No.: US 11,264,161 B2
(45) Date of Patent: Mar. 1, 2022

(54) COIL ELECTRONIC COMPONENT

(71) Applicant: SAMSUNG ELECTRO-MECHANICS CO., LTD., Suwon-si (KR)

(72) Inventors: Chan Yoon, Suwon-si (KR); Dong Hwan Lee, Suwon-si (KR); Dong Jin Lee, Suwon-si (KR); Young Ghyu Ahn, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 382 days.

(21) Appl. No.: 16/281,687

(22) Filed: Feb. 21, 2019

(65) Prior Publication Data

US 2020/0105454 A1 Apr. 2, 2020

(30) Foreign Application Priority Data

Sep. 28, 2018 (KR) ..... 10-2018-0115634

(51) Int. Cl.
*H01F 27/29* (2006.01)
*H01F 27/28* (2006.01)
*H01F 27/24* (2006.01)

(52) U.S. Cl.
CPC ..... *H01F 27/2804* (2013.01); *H01F 27/24* (2013.01); *H01F 27/29* (2013.01); *H01F 2027/2809* (2013.01)

(58) Field of Classification Search
CPC ..... H01F 27/2804; H01F 27/24; H01F 27/29; H01F 2027/2809; H01F 27/292; H01F 2017/048; H01F 17/0013; H01F 27/28; H01F 27/306
See application file for complete search history.

(56) References Cited

U.S. PATENT DOCUMENTS

2010/0001823 A1* 1/2010 Kawarai ..... H01F 17/0013 336/200
2015/0187484 A1* 7/2015 Jeong ..... H01F 27/292 336/200
2016/0172103 A1* 6/2016 Jeong ..... H01F 27/255 336/192

(Continued)

FOREIGN PATENT DOCUMENTS

KR 10-2016-0081054 A 7/2016
KR 10-1792317 B1 10/2017

*Primary Examiner* — Mang Tin Bik Lian
(74) *Attorney, Agent, or Firm* — Morgan, Lewis & Bockius LLP

(57) ABSTRACT

A coil electronic component includes a support substrate, a coil pattern disposed on at least one surface of the support substrate, a lead-out pattern disposed on at least one surface of the support substrate to be connected to the coil pattern, an encapsulant disposed to encapsulate the support substrate, the coil pattern, and at least one portion of the lead-out pattern, and an external electrode disposed on an external surface of the encapsulant to be connected to the lead-out pattern. The lead-out pattern includes a slit disposed on a side of a region facing the external electrode. The slit is exposed in a direction toward the external electrode and in a direction away from the support substrate, on the basis of a thickness direction of the support substrate, and is not connected to the support substrate.

19 Claims, 4 Drawing Sheets

(56) References Cited

U.S. PATENT DOCUMENTS

| | | | | |
|---|---|---|---|---|
| 2016/0189840 | A1* | 6/2016 | Ahn | H01F 17/0013 336/192 |
| 2016/0343489 | A1* | 11/2016 | Horikawa | H01F 27/292 |
| 2016/0351313 | A1* | 12/2016 | Jeong | H01F 17/0013 |
| 2016/0351319 | A1* | 12/2016 | Jeong | H01F 17/0013 |

* cited by examiner

--RELATED ART--

--RELATED ART--

COIL ELECTRONIC COMPONENT

CROSS-REFERENCE TO RELATED APPLICATION(S)

This application claims the benefit of priority to Korean Patent Application No. 10-2018-0115634 filed on Sep. 28, 2018 in the Korean Intellectual Property Office, the disclosure of which is incorporated herein by reference in its entirety.

TECHNICAL FIELD

The present disclosure relates to a coil electronic component.

BACKGROUND

As the miniaturization and thinning of various electronic devices, such as digital televisions (TVs), mobile phones, laptop computers, and the like, have accelerated with the development of information technology (IT), coil electronic components applied to such electronic devices have also been required to be miniaturized and thinned. To satisfy such a requirement, research into winding type or thin film type coil components having various shapes has been actively conducted.

A major issue, depending on the miniaturization and thinning of coil electronic components, is to implement the same characteristics as existing coil electronic components in spite of such miniaturization and thinning. In this regard, it is necessary to increase a ratio of a magnetic material in a core filled with the magnetic material. However, there may be a limitation in increasing the ratio of the magnetic material due to strength of an inductor body, frequency characteristic variation depending on insulating properties, and the like.

In the case of such a coil electronic component, attempts have been made to further decrease a chip thickness with the recent trend for complexity, multifunctionality, and slimming of devices. Accordingly, there is a need for a method of securing high performance and high reliability in spite of such a trend of slimming chips.

SUMMARY

An aspect of the present disclosure is to provide a coil electronic component in which bonding force between a coil pattern and an encapsulant is increased to improve reliability when external stress, occurring when a dicing process or the like is applied, and a contact area with an external electrode is sufficiently secured to significantly reduce deterioration in electrical characteristics.

According to an aspect of the present disclosure, a coil electronic component includes a support substrate, a coil pattern disposed on at least one surface of the support substrate, a lead-out pattern disposed on the at least one surface of the support substrate to be connected to the coil pattern, an encapsulant encapsulating at least a portion of the support substrate, the coil pattern, and the lead-out pattern, and an external electrode disposed on an external surface of the encapsulant to be electrically connected to the lead-out pattern. The lead-out pattern includes a slit disposed on a side surface thereof facing the external electrode. The slit is exposed in a direction toward the external electrode and in a direction away from the at least one surface of the support substrate, and is not connected to the support substrate.

The encapsulant may fill the slit.

The encapsulant filling the slit may include a magnetic material.

An encapsulant filling the lead-out pattern and the slit may be in contact with the external electrode.

Bonding force between the encapsulant, filling the slit, and the external electrode may be greater than bonding force between the lead-out pattern and the external electrode.

The lead-out pattern may include a plurality of slits.

The plurality of slits may have the same shape.

The lead-out pattern may further include an anchor portion having a shape penetrating a region between the slit and the support substrate.

The encapsulant may fill the anchor portion of the lead-out pattern.

The anchor portion of the lead-out pattern may be provided in plural.

The anchor portion of the lead-out pattern may be connected to the support substrate.

The lead-out pattern may have a width greater than a width of the coil pattern.

According to another aspect of the present disclosure, a coil electronic component includes a support substrate, a coil pattern disposed on at least one surface of the support substrate, a lead-out pattern disposed on the at least one surface of the support substrate to be connected to the coil pattern, an encapsulant encapsulating at least a portion of the support substrate, the coil pattern, and the lead-out pattern, and an external electrode disposed on an external surface of the encapsulant to be electrically connected to the lead-out pattern. The lead-out pattern includes a cut-out portion recessed from a side surface thereof facing the external electrode and from an upper surface thereof opposing the at least one surface of the support substrate, such that a center of a corner edge of the lead-out pattern, which is in contact with the external electrode and is away from the support substrate, is indented, and a bottom inner surface of the cut-out portion is spaced apart from the at least one surface of the support substrate in the stacking direction.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Hereinafter, embodiments of the present disclosure will be described as follows with reference to the attached drawings.

Figure 1:
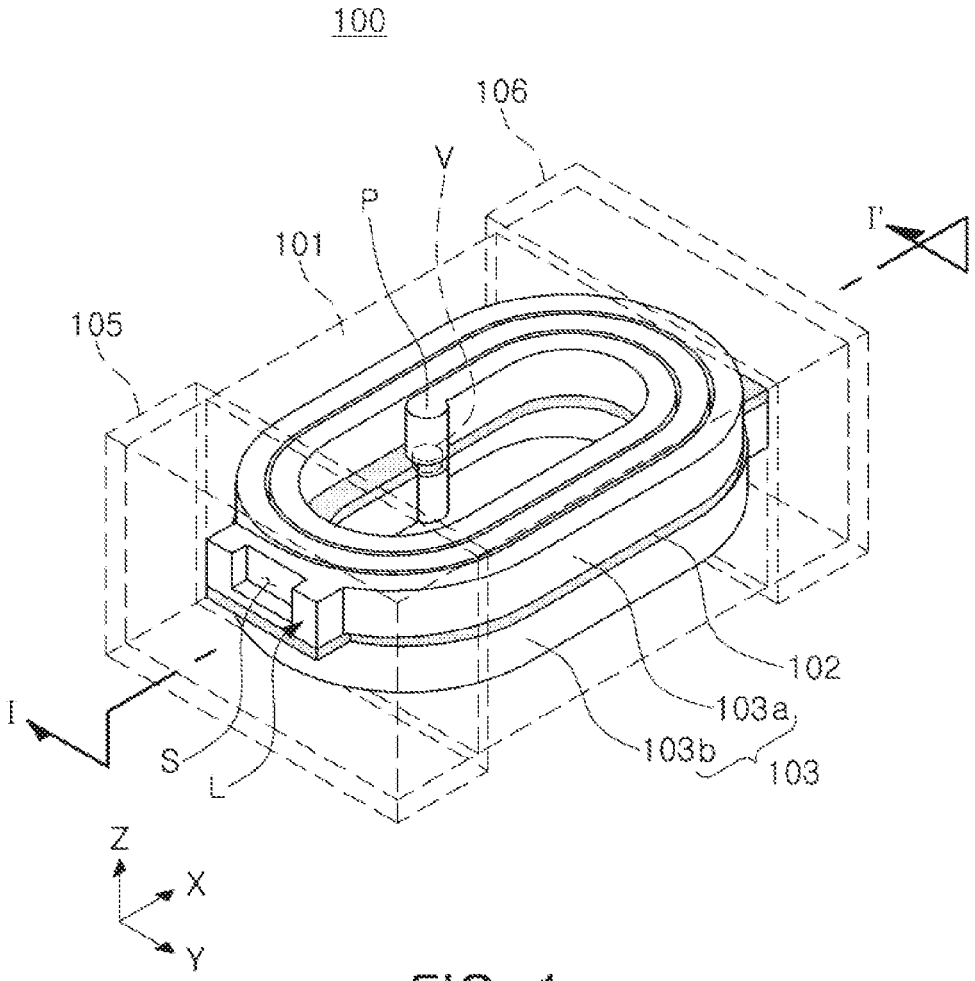
FIG. 1 is a perspective view of a coil electronic component according to an exemplary embodiment in the present disclosure.
Figure 2:
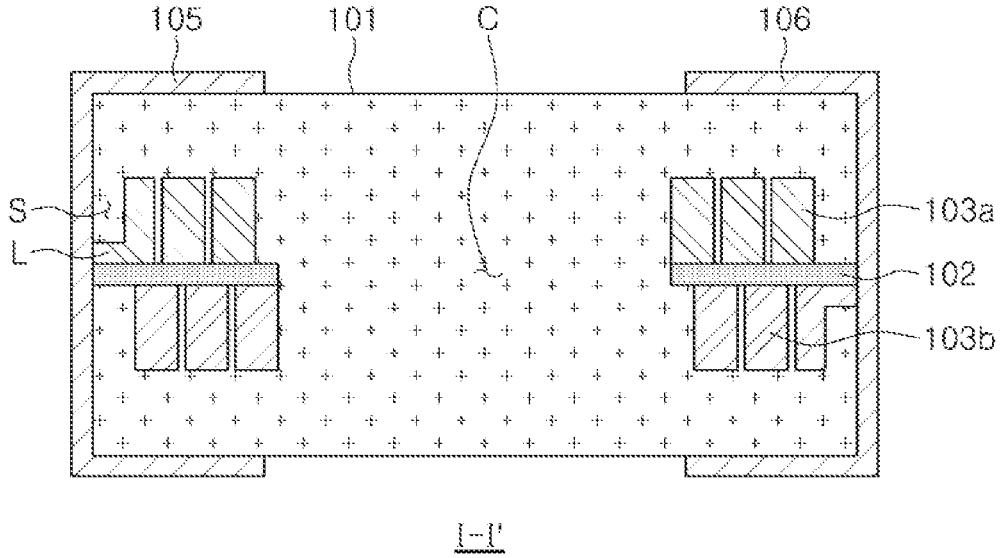
FIG. 2 is a cross-sectional view taken along line I-I' in FIG. 1.
Figure 3A:
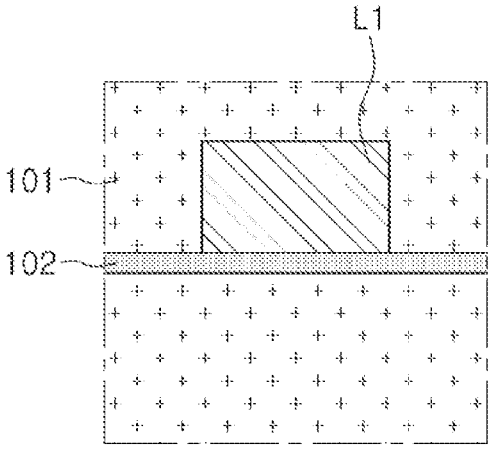
FIGS. 3A, 3B, and 3C are cross-sectional views, illustrating various shapes of a lead-out pattern, in which FIGS. 3A and 3B correspond to related-art inventions and FIG. 3C corresponds to an exemplary embodiment in the present disclosure.
Figure 3B:
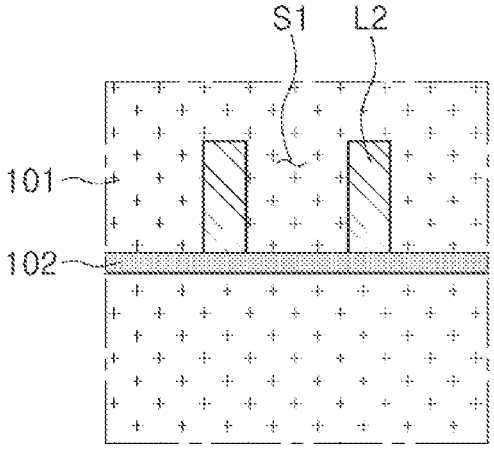
Figure 3C:
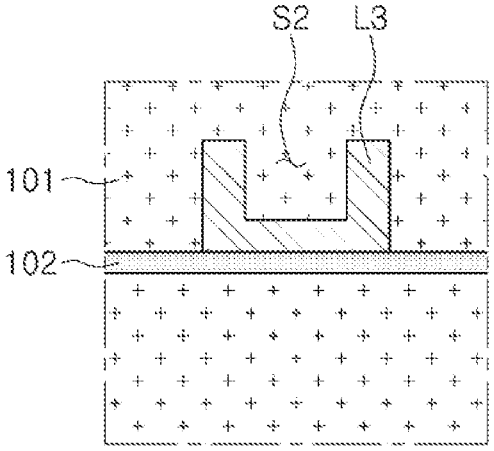

FIG. 1 is a perspective view of a coil electronic component according to an exemplary embodiment in the present disclosure, and FIG. 2 is a cross-sectional view taken along line I-I' in FIG. 1. FIGS. 3A to 3C are cross-sectional views, illustrating various shapes of a lead-out pattern, in which FIGS. 3A and 3B correspond to related-art inventions and FIG. 3C corresponds to an exemplary embodiment in the present disclosure; and Referring to FIGS. 1 to 3, a coil electronic component 100 according to an exemplary embodiment includes a support substrate 102, a coil pattern 103, a lead-out pattern L, an encapsulant 101, and external electrodes 105 and 106. The lead-out pattern L includes a slit S.

The encapsulant 101 encapsulates at least a portion of the support substrate 102, the coil pattern 103, and the lead-out pattern L to obtain an appearance of the coil electronic component 100. In this case, the encapsulant 101 may be formed in such a manner that a portion of the lead-out pattern L is exposed outwardly. The encapsulant 101 may include magnetic particles, and an insulating resin may be interposed between the magnetic particles. In addition, an insulating layer may be coated on surfaces of the magnetic particles.

The magnetic particles, which may be contained in the encapsulant 101, include a ferrite, a metal, and the like. In the case of a metal, for example, an iron (Fe)-based alloy may be used. Specifically, the magnetic particles may be formed of a nanocrystalline alloy, an iron-nickel (Fe—Ni) alloy, or the like having an iron-silicon-boron-chromium (Fe—Si—B—Cr) composition. When the magnetic particles 112 are formed of the Fe-based alloy as described above, they have improved magnetic properties such as magnetic permeability but may be vulnerable to electrostatic discharge (ESD). Accordingly, an additional insulating structure may be interposed between the coil pattern 103 and the magnetic particles.

The coil pattern 103 may have a spiral structure that forms one or more turns, and may be disposed on at least one surface of the support substrate 102. In the present embodiment, the coil pattern 103 includes first and second coil patterns 103*a* and 103*b* disposed on two opposing surfaces of the support substrate 102. In this case, the first and second coil patterns 103*a* and 103*b* may include a pad region P and may be connected to each other by a via V passing through the supporting substrate 102. The coil pattern 103 may be formed by a plating process, used in the art, such as pattern plating, anisotropic plating, isotropic plating, or the like, and may be formed to have a multilayer structure using a plurality of processes among these processes.

The support substrate 102, supporting the coil pattern 103 and the like, may be a polypropylene glycol (PPG) substrate, a ferrite substrate, a metal-based soft magnetic substrate, or the like. As illustrated, a through-hole may be performed to penetrate a central portion of the supporting substrate 102. The through-hole may be filled with the encapsulant 101 to form a core portion C.

The external electrodes 105 and 106 are disposed outwardly of the encapsulant 101 and are connected to the lead-out pattern L. The external electrodes 105 and 106 may be formed using a paste containing a metal having improved electrical conductivity and may be formed of a metal such as nickel (Ni), copper (Cu), tin (Sn), or alloys thereof. Further, a plating layer may further be formed on the external electrodes 105 and 106. In this case, the plating layer may include at least one selected from the group consisting of nickel (Ni), copper (Cu), and tin (Sn). For example, a nickel (Ni) layer and a tin (Sn) may be sequentially formed.

The lead-out pattern L may be disposed at an outermost portion of the coil pattern 103 to provide a connection path with the external electrodes 105 and 106 and may be integrated with the coil pattern 103 into a single body. In this case, the lead-out pattern L may be implemented to have a width greater than a width of the coil pattern 103 to be connected to the external electrodes 105 and 106, as illustrated. The term "width" refers to a width in an X direction.

In the present embodiment, the lead-out pattern L includes a slit S respectively formed on sides of regions facing the external electrodes 105 and 106. More specifically, the slit S is exposed in a direction toward the external electrodes 105 and 106, for example, in a direction outwardly of the encapsulant 101 and a direction away from the support substrate 102, on the basis of a thickness direction (Z direction) of the support substrate 102, and is not connected to the support substrate 102.

The encapsulant 101 may fill the slit S of the lead-out pattern L. The encapsulant 101 filling the lead-out pattern L and the slit S may be in contact with the external electrodes 105 and 106. As described above, the encapsulant 101 may include a magnetic material having a magnetic particle shape or the like. Accordingly, a magnetic material may also be contained in the encapsulant 101 filling the slit S. The amount of the magnetic material contained in the coil electronic component 100 may be increased by the slit S to improve magnetic characteristics.

Bonding force between the encapsulant 101, filling the slit S, and the external electrodes 105 and 106 may be greater than bonding force between the lead-out pattern L and the external electrodes 105 and 106. Thus, the external electrodes 105 and 106 may be stably coupled to the lead-out pattern L. Since an area of the encapsulant 101, filling the slit S, may serve as an anchor, bonding force between the encapsulant 101 and the coil pattern 103, and the lead-out pattern L may be improved. Accordingly, when an external impact such as a process of dicing the encapsulant 101 is generated, structural stability is improved and cracking or the like may be reduced.

In the present embodiment, adhesion force between the encapsulant 101 and the coil pattern 103 is improved by the slit S of the lead-out pattern L, and a contact area between the lead-out pattern L and the external electrode 105 and 106 may be sufficiently secured to significantly reduce deterioration in electrical characteristics, which will be described with reference to FIG. 3. In FIG. 3A, a lead-out pattern L1 does not include a slit and has a rectangular contact surface with an external electrode. In the case of the lead-out pattern L1 having such a shape, bonding force between an encapsulant 101 and the coil pattern or between the encapsulant 101 and the lead-out pattern L1 is not sufficient. Therefore, structural stability may not be high and cracking may occur during a process. In FIG. 3B, although a lead-out pattern L2 include a slit S1 to secure structural stability of an encapsulant 101 and a lead-out pattern L2, a contact area between the lead-out pattern L2 and an external electrode is significantly reduced. As a result, electrical resistance between the lead-out pattern L2 and the external electrode may be increased to deteriorate characteristics of a coil electronic component.

In FIG. 3C, a slit S2 is provided as a lead-out pattern L3 according to an exemplary embodiment. As described above, the slit S2 is exposed in a direction toward an external electrode and a direction away from a support substrate 102 (upward direction) and is not connected to the support substrate 102. An encapsulant 101 may efficiently fill the slit S2 from the exposure direction. The lead-out pattern L3 includes the slit S2 to have improved bonding force to the encapsulant 101. The lead-out pattern L3 is also present between the slit S2 and the support substrate 102. Since the lead-out pattern L3 has a larger contact area with the external electrode than the lead-out pattern L3 in FIG. 3B, the lead-out pattern L3 has more improved electrical characteristics. As described above, the slit S2 is formed in the lead-out pattern L3 and the exposure direction thereof is adjusted. Thus, both structural stability and electrical characteristics are improved.

Figure 4:
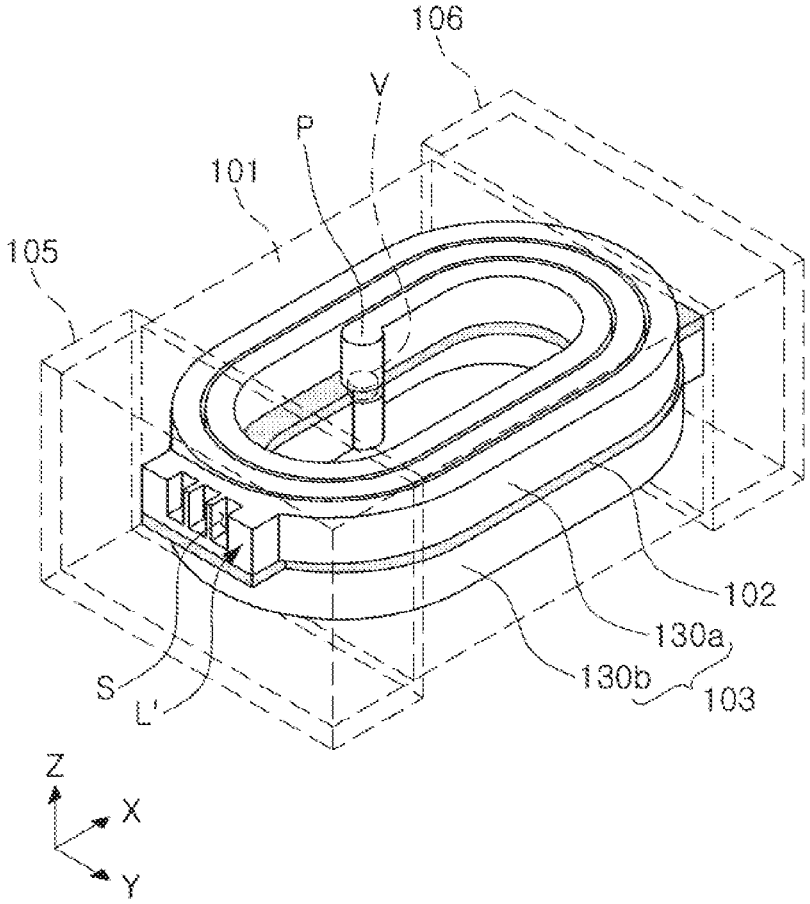
FIGS. 4 and 5 illustrate coil electronic components according to modified embodiments in the present disclosure, respectively.
Figure 5:
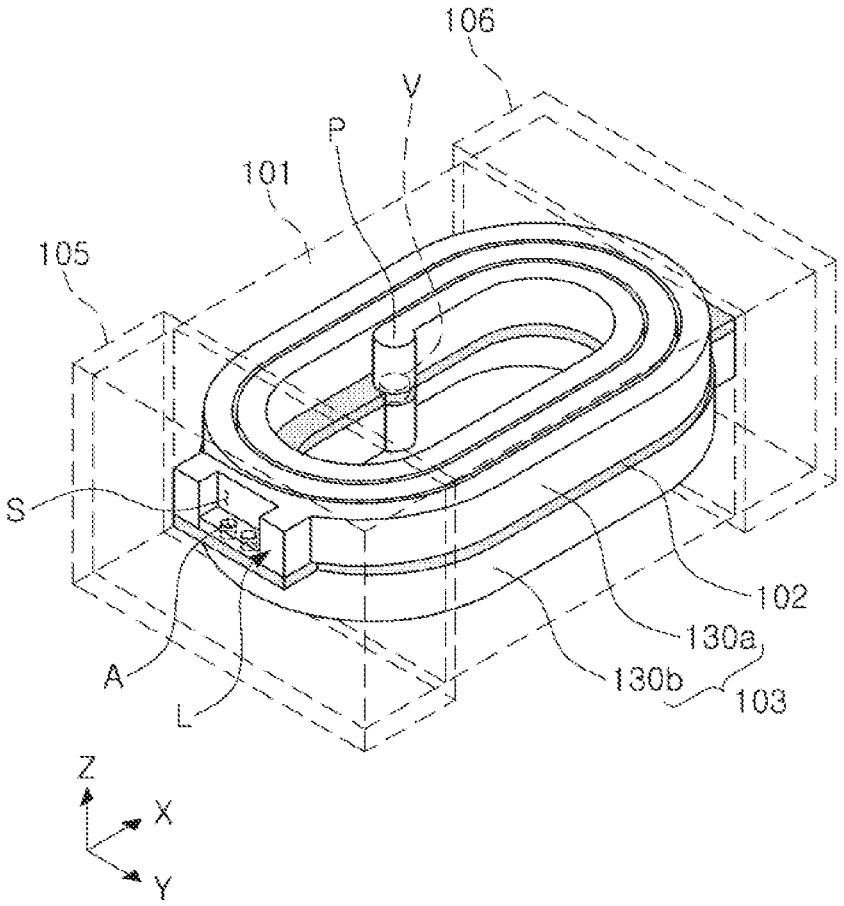

FIGS. 4 and 5 illustrate coil electronic components according to modified embodiments in the present disclosure, respectively. Hereinafter, only lead-out patterns, which are modified components, will be described. In the case of a coil electronic component according to a modified embodiment of FIG. 4, a lead-out pattern L' includes a plurality of slits S.

Similarly to the above-described embodiment, the slit S is exposed in a direction toward external electrodes 105 and 106 and in a direction away from a support substrate 102 and is not connected to the support substrate 102. As illustrated in FIG. 4, the plurality of slits S may have the same shape as each other, but are not limited thereto. At least some of the plurality of slits S may have different shapes from each other. A contact area of the lead-out pattern L' with the external electrodes 105 and 106 may be increased, and a contact area between the lead pattern L' and an encapsulant 101 may be increased. Thus, adhesion therebetween is advantageously improved.

In an exemplary embodiment in FIG. 5, a lead-out pattern L in FIG. 1 further includes an anchor portion A in addition to a slit S. The anchor portion A has a shape, penetrating a region between the slit S and a support substrate 102 in a thickness direction, and may be connected to the support substrate 102. An encapsulant 100 may fill the anchor portion A to further improve bonding force between the encapsulant 101 and the lead-out pattern L. In the exemplary embodiment in FIG. 5, two anchor portions A of the lead-out pattern L are provided. However, a single anchor portion A or three or more anchor portions A may be provided, as needed.

As described above, in a coil electronic component according to an exemplary embodiment, bonding force between a coil pattern and an encapsulant may be increased to improve reliability when external stress such as a dicing process is applied. Additionally, a contact area with an external electrode may be sufficiently secured to significantly reduce deterioration in electrical characteristics.

While exemplary embodiments have been shown and described above, it will be apparent to those skilled in the art that modifications and variations could be made without departing from the scope of the present invention as defined by the appended claims.

What is claimed is:

1. A coil electronic component comprising:

a support substrate;

a coil pattern disposed on at least one surface of the support substrate;

a lead-out pattern disposed on the at least one surface of the support substrate to be connected to the coil pattern;

an encapsulant encapsulating at least a portion of the support substrate, the coil pattern, and the lead-out pattern; and an external electrode disposed on an external surface of the encapsulant to be electrically connected to the lead-out pattern, wherein the lead-out pattern includes a slit disposed on a side surface thereof facing the external electrode, the slit is exposed in a first direction toward the external electrode and in a second direction away from the at least one surface of the support substrate on which the lead-out pattern is disposed, and is not connected to the support substrate, and the slit is arranged between first and second portions of the lead-out pattern in a third direction perpendicular to the first and second directions.

2. The coil electronic component of claim 1, wherein the encapsulant fills the slit.

3. The coil electronic component of claim 2, wherein the encapsulant filling the slit includes a magnetic material.

4. The coil electronic component of claim 2, wherein the encapsulant fills the slit and is in contact with the external electrode.

5. The coil electronic component of claim 4, wherein bonding force between the encapsulant, filling the slit, and the external electrode is greater than bonding force between the lead-out pattern and the external electrode.

6. The coil electronic component of claim 1, wherein the lead-out pattern includes a plurality of slits.

7. The coil electronic component of claim 6, wherein the plurality of slits have the same shape.

8. The coil electronic component of claim 1, wherein the lead-out pattern further includes an anchor portion having a shape penetrating a region between the slit and the support substrate.

9. The coil electronic component of claim 8, wherein the encapsulant fills the anchor portion of the lead-out pattern.

10. The coil electronic component of claim 8, wherein the anchor portion of the lead-out pattern is provided in plural.

11. The coil electronic component of claim 8, wherein the anchor portion of the lead-out pattern is connected to the support substrate.

12. The coil electronic component of claim 1, wherein the lead-out pattern has a width greater than a width of the coil pattern.

13. A coil electronic component comprising:

a support substrate;

a coil pattern disposed on at least one surface of the support substrate in a stacking direction;

a lead-out pattern disposed on the at least one surface of the support substrate in the stacking direction to be connected to the coil pattern;

an encapsulant encapsulating at least a portion of the support substrate, the coil pattern, and the lead-out pattern; and an external electrode disposed on an external surface of the encapsulant to be electrically connected to the lead-out pattern, wherein the lead-out pattern includes a cut-out portion recessed from a side surface thereof facing the external electrode and from an upper surface thereof opposing the at least one surface of the support substrate, a bottom inner surface of the cut-out portion is spaced apart from the at least one surface of the support substrate in the stacking direction, and the cut-out portion is arranged between first and second portions of the lead-out pattern in a width direction perpendicular to the stacking direction.

14. The coil electronic component of claim 13, wherein the encapsulant fills the cut-out portion and includes a magnetic material.

15. The coil electronic component of claim 14, wherein the encapsulant fills the cut-out portion and is in contact with the external electrode.

16. The coil electronic component of claim 13, wherein the cut-out portion is provided in plural and spaced apart from each other.

17. The coil electronic component of claim 13, wherein the lead-out pattern further includes an anchor portion having a shape penetrating a region between the cut-out portion and the support substrate.

18. The coil electronic component of claim 17, wherein the anchor portion of the lead-out pattern is provided in plural.

19. The coil electronic component of claim 17, wherein the anchor portion of the lead-out pattern is connected to the support substrate.

* * * * *